US005153612A

United States Patent [19]

Dunn et al.

[11] Patent Number: 5,153,612

[45] Date of Patent: Oct. 6, 1992

[54] INK DELIVERY SYSTEM FOR AN INK-JET PEN

[75] Inventors: John B. Dunn; Bruce Cowger, both of Corvallis, Oreg.

[73] Assignee: Hewlett-Packard Company, Palo Alto, Calif.

[21] Appl. No.: 637,247

[22] Filed: Jan. 3, 1991

[51] Int. Cl.[5] ..... B41J 2/175

[52] U.S. Cl. ..... 346/140 R

[58] Field of Search ..... 346/140 PD, 140 R, 75; 400/719

[56] References Cited

U.S. PATENT DOCUMENTS

| | | | |
|---|---|---|---|
| 3,946,398 | 3/1976 | Kyser et al. | 346/140 R |
| 4,149,172 | 4/1979 | Heinzl et al. | 346/140 R |
| 4,217,058 | 8/1980 | Strazewski et al. | 401/135 |
| 4,272,773 | 6/1981 | Halasz | 346/140 R |
| 4,342,042 | 7/1982 | Cruz-Uribe et al. | 346/140 R |
| 4,412,232 | 10/1983 | Weber et al. | 346/140 R |
| 4,422,084 | 12/1983 | Saito | 346/140 R |
| 4,500,895 | 2/1985 | Buck et al. | 346/140 R |
| 4,503,443 | 3/1985 | Dagna | 346/140 R |
| 4,509,062 | 4/1985 | Low et al. | 346/140 R |
| 4,673,955 | 6/1987 | Ameyama et al. | 346/140 R |
| 4,677,447 | 6/1987 | Nielsen | 346/140 R |
| 4,689,642 | 8/1987 | Sugitani | 346/140 R |
| 4,712,172 | 12/1987 | Kiyohara et al. | 346/140 R |
| 4,714,937 | 12/1987 | Kaplinsky | 346/140 R |
| 4,785,314 | 11/1988 | Terasawa et al. | 346/140 R |
| 4,791,438 | 12/1988 | Hanson et al. | 346/140 R |
| 4,794,409 | 12/1988 | Cowger et al. | 346/140 R |
| 4,920,362 | 4/1990 | Cowger et al. | 346/140 R |
| 4,931,812 | 6/1990 | Dunn et al. | 346/140 A |
| 4,961,076 | 10/1990 | Cowger | 346/1.1 |
| 4,992,802 | 2/1991 | Dion et al. | 346/1.1 |
| 4,994,824 | 2/1991 | Winslow | 346/140 R |
| 5,010,354 | 4/1991 | Cowger et al. | 346/140 R |
| 5,040,001 | 8/1991 | Dunn et al. | 346/140 R |
| 5,040,002 | 8/1991 | Pollacek et al. | 346/140 R |

FOREIGN PATENT DOCUMENTS

| | | | |
|---|---|---|---|
| 28319999 B1 | 2/1980 | Fed. Rep. of Germany . | |
| 2831973 B2 | 5/1980 | Fed. Rep. of Germany . | |
| 0042875 | 3/1980 | Japan | 346/140 PD |
| 0042877 | 3/1980 | Japan | 346/140 PD |

OTHER PUBLICATIONS

Nielsen, "History of ThinkJet Printhead Development," *Hewlett-Packard Journal,* May, 1985, pp. 4-10.

Allen, et al., "Thermodynamics and Hydrodynamics of Thermal Ink Jets," *Hewlett-Packard Journal,* May, 1985, pp. 21-27.

*Primary Examiner*—Benjamin R. Fuller
*Assistant Examiner*—Alrick Bobb

[57] ABSTRACT

A flexible reservoir bladder is connected to the base of a pen body to define a reservoir volume that permits nearly all of the ink contained therein to be delivered from the pen by a print head. The back pressure developed within the reservoir volume is regulated by the resilient properties of the bladder and an orifice that permits controlled entry of air into the volume as the ink is depleted. The system is able to withstand severe environmental effects, such as a drop in ambient air pressure, while preventing pen leakage.

11 Claims, 2 Drawing Sheets

FIG. 4
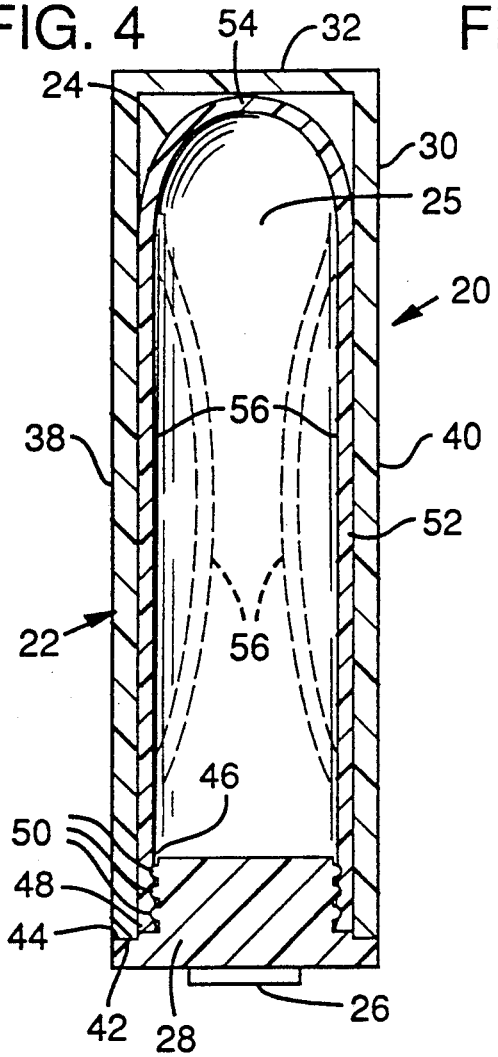
FIG. 3
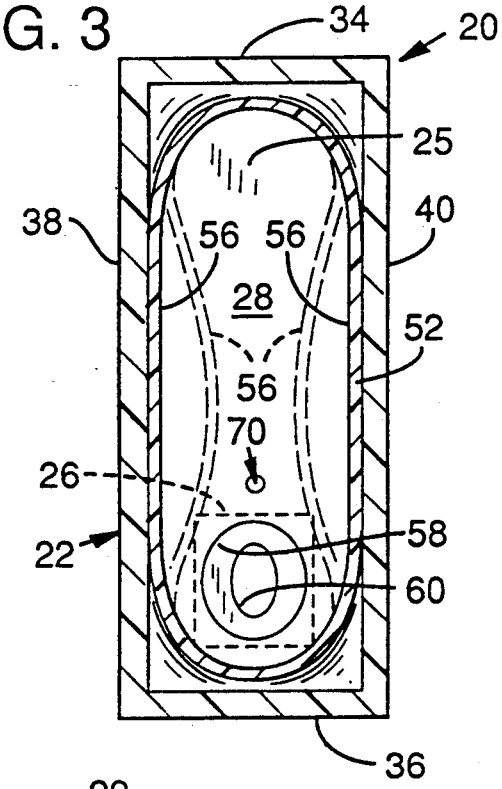
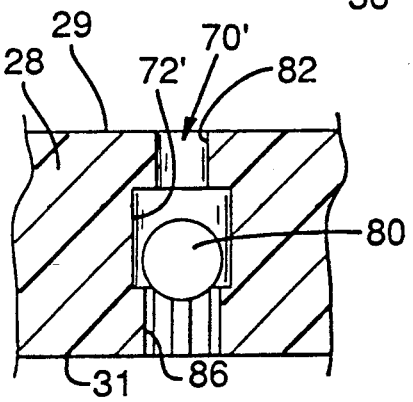
FIG. 5
FIG. 6
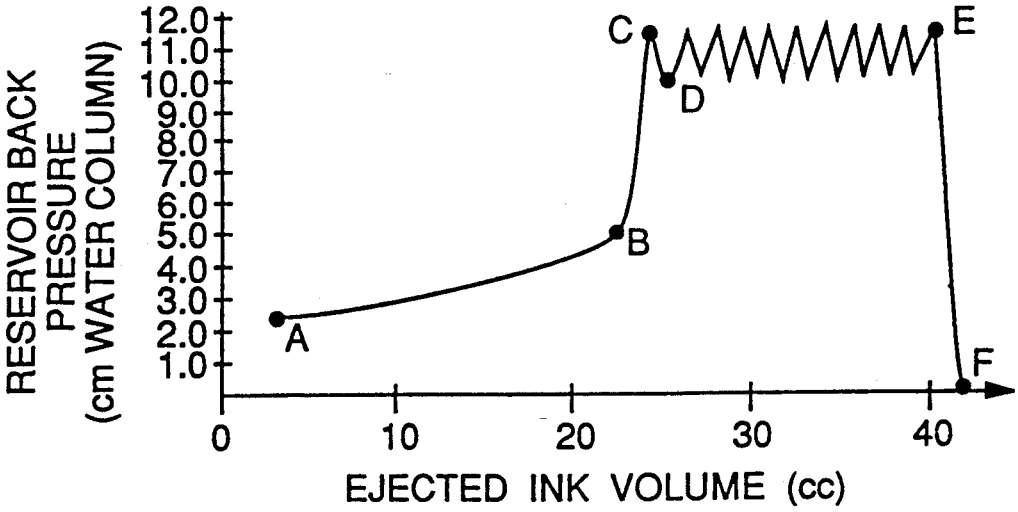

INK DELIVERY SYSTEM FOR AN INK-JET PEN

TECHNICAL FIELD

This invention pertains to systems for delivering ink from ink-jet pens.

BACKGROUND INFORMATION

Ink-jet printing generally involves the controlled delivery of ink drops from an ink-jet pen reservoir to a printing surface. One type of ink-jet printing, known as drop-on-demand printing, employs a pen that has a print head and ink reservoir. The print head is responsive to control signals for ejecting drops of ink from the ink reservoir.

Drop-on-demand type print heads typically use one of two mechanisms for ejecting drops: thermal bubble or piezoelectric pressure wave. A thermal bubble type print head includes a thin-film resistor that is heated to cause sudden vaporization of a small portion of the ink. The rapid expansion of the ink vapor forces a small amount of ink through a print head orifice.

Piezoelectric pressure wave type print heads use a piezoelectric element that is responsive to a control signal for abruptly compressing a volume of ink in the print head to produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require the fluid in the ink reservoir to be stored in a manner that provides a slight back pressure at the print head to prevent ink leakage from the pen whenever the print head is inactive. As used herein, the term "back pressure" means the partial vacuum within the pen reservoir that resists the flow of ink through the print head. Back pressure is considered in the positive sense so that an increase in back pressure represents an increase in the partial vacuum. Accordingly, back pressure is measured in positive terms, such as centimeter (cm) of water column height.

The back pressure at the print head must be at all times strong enough for preventing ink leakage through the print head. The back pressure, however, must not be so strong that the print head is unable to overcome the back pressure to eject ink drops. Moreover, the ink-jet pen must be designed to operate despite environmental changes that cause fluctuations in the back pressure.

A severe environmental change that affects reservoir back pressure occurs during air transport of an ink-jet pen. In this instance, ambient air pressure decreases as the aircraft gains altitude and is depressurized. As ambient air pressure decreases, a correspondingly greater amount of back pressure is needed to keep ink from leaking through the print head. Accordingly, the level of back pressure within the pen must be regulated during times of ambient pressure drop.

The back pressure within an ink-jet pen reservoir is also subjected to what may be termed "operational effects." One significant operational effect occurs as the print head is activated to eject ink drops. The consequent depletion of ink from the reservoir increases (makes more negative) the reservoir back pressure. Without regulation of this back pressure increase, the ink-jet pen will eventually fail because the print head will be unable to overcome the increased back pressure to eject ink drops. Such failure wastes ink whenever the failure occurs before all of the useable ink within the reservoir has been ejected.

Past efforts to regulate ink-jet reservoir back pressure in response to environmental changes and operational effects have included mechanisms that may be collectively referred to as accumulators. Examples of accumulators are described in U.S. Pat. Application No. 07/289,876 now U.S. Pat. No. 4,992,802 issued Feb. 12, 1991, entitled METHOD AND APPARATUS FOR EXTENDING THE ENVIRONMENTAL RANGE OF AN INK JET PRINT CARTRIDGE.

Generally, prior accumulators comprise a movable cup-like mechanism that defines an accumulator volume that is in fluid communication with the ink-jet pen reservoir volume. The accumulators are designed to move between a minimum volume position and a maximum volume position in response to changes in the level of the back pressure within the reservoir. Accumulator movement changes the overall volume of the reservoir to regulate back pressure level changes so that the back pressure remains within an operating range that is suitable for preventing ink leakage while permitting the print head to continue ejecting ink drops.

For example, as the difference between ambient pressure and the back pressure within the pen decreases as a result of ambient air pressure drop, the accumulator moves to increase the reservoir volume, thereby to increase the back pressure to a level (within the operating range mentioned above) that prevents ink leakage. Put another way, the increased volume attributable to accumulator movement prevents a reduction in the difference between ambient air pressure and back pressure that would otherwise occur if the reservoir were constrained to a fixed volume as ambient air pressure decreased.

Accumulators also move to decrease the reservoir volume whenever environmental changes or operational effects (for example, ink depletion occurring during operation of the pen) cause an increase in the back pressure. The decreased volume attributable to accumulator movement reduces the back pressure to a level within the operating range, thereby permitting the print head to continue ejecting ink.

Past accumulators have been used with devices known as bubble generators. Bubble generators permit air bubbles to enter the ink reservoir once the accumulator has moved to the minimum volume position (that is, once the accumulator is unable to further reduce the back pressure within the reservoir) and the back pressure continues to rise as the print head continues to eject ink from the reservoir. The effect of the air bubbles delivered by the bubble generator is to keep the reservoir back pressure from increasing to a level that would cause failure of the print head.

Accumulators are usually equipped with internal or external resilient mechanisms that continuously urge the accumulators toward a position for increasing the volume of the reservoir. The effect of the resilient mechanisms is to retain a sufficient minimum back pressure within the reservoir (to prevent ink leakage) even as the accumulator moves to increase or decrease the reservoir volume.

Prior accumulators were constructed as discrete components that were mounted to support mechanisms carried within the pen body. To provide the pen with the greatest volumetric efficiency, the working volume of the accumulator (that is, the maximum reservoir volume increase or decrease that is provided by the accumulator) was limited in size so that the accumulator and associated support mechanisms displaced as little reservoir volume as possible. Accordingly, the environmental operating range of prior pens, which range may be quantified as the maximum ambient pressure drop the pen could sustain without leakage, was limited by the size of the working volume of the accumulator.

One prior approach to overcoming the working volume size limitation just described lead to the inclusion of a catch basin within the ink-jet pen. The catch basin provides a volume for receiving through an overflow orifice ink that is forced out of the reservoir as ambient pressure continues to drop after the accumulator moves into its maximum volume position. The continued drop in ambient pressure eventually eliminates the difference between ambient pressure and the back pressure within the reservoir so that a low-level positive pressure develops within the reservoir. The low-level positive pressure forces ink through the overflow orifice into the catch basin. The inclusion of the overflow orifice and catch basin is intended to prevent the positive pressure in the reservoir from rising to a level that would force ink out of the inactive print head.

Use of catch basins is undesirable because such basins require space within the ink-jet pen assembly that could otherwise be used as ink reservoir space. Moreover, it is difficult to design the pen so that ink is forced through an overflow orifice but not through the print head.

SUMMARY OF THE INVENTION

This invention is directed to an ink delivery system that combines a flexible-bladder ink reservoir with a bubble generator for controlling back pressure within the reservoir while providing substantially complete delivery of the ink within the reservoir. The delivery system of the present invention provides a simplified construction and eliminates the need for many space-depleting support mechanisms. Moreover, the volumetric efficiency of the pen is enhanced because no catch basin is required.

The system of the present invention particularly comprises a pen body that has base and a housing attached to the base. A deformable bladder is located inside the housing and has an open end sealed to base of the pen. The interior of the bladder and the upper surface of the base define the reservoir volume for storing ink. The system includes a print head for ejecting ink from the reservoir volume. As the back pressure within reservoir volume increases as ink is ejected, the deformable bladder collapses to reduce the reservoir volume and thereby prevent the back pressure from reaching a level sufficient to cause failure of the pen.

As the print head continues to operate, the bladder reaches a fully collapsed position and is thereafter no longer able to limit the back pressure. In this instance, a bubble generator that is mounted to the base of the pen begins to deliver air bubbles into the reservoir volume to prevent the back pressure within the reservoir volume from reaching the level that would cause the print head to fail.

In addition to its function as a collapsible reservoir bladder, the bladder is expandable, via its internal resilience, in order to increase the reservoir volume for the purpose of regulating the back pressure therein in the event an a environmental effect, such as a drop in ambient air pressure, necessitates an increase in reservoir back pressure.

BRIEF DESCRIPTION OF THE DRAWINGS

FIG. 3 is a cross sectional view taken along line 3—3 of FIG. 1. FIG. 4 is a cross sectional view taken along line 4—4 of FIG. 1.

FIG. 5 is an enlarged sectional view of one preferred bubble generator usable with the present invention.

FIG. 6 is a graph showing the relationship between the back pressure in the pen reservoir and the amount of ink ejected from the pen.

DETAILED DESCRIPTION

Referring to FIGS. 1 through 5, an ink-jet pen 20 includes an ink delivery system formed in accordance with the present invention. The pen 20 comprises a pen body 22 within which is mounted a flexible bladder 24 that serves as a reservoir for ink.

Figure 1:
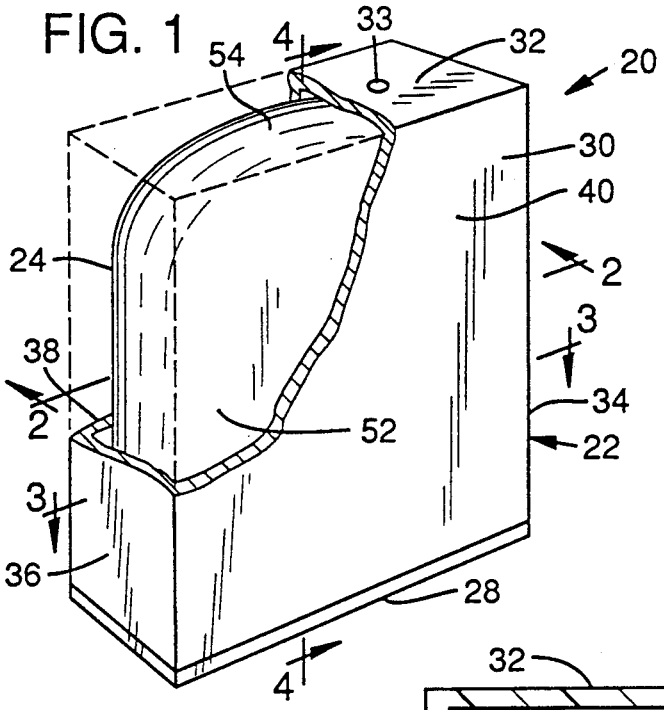
FIG. 1 is a perspective view of a preferred ink delivery system for an ink-jet pen.
Figure 2:
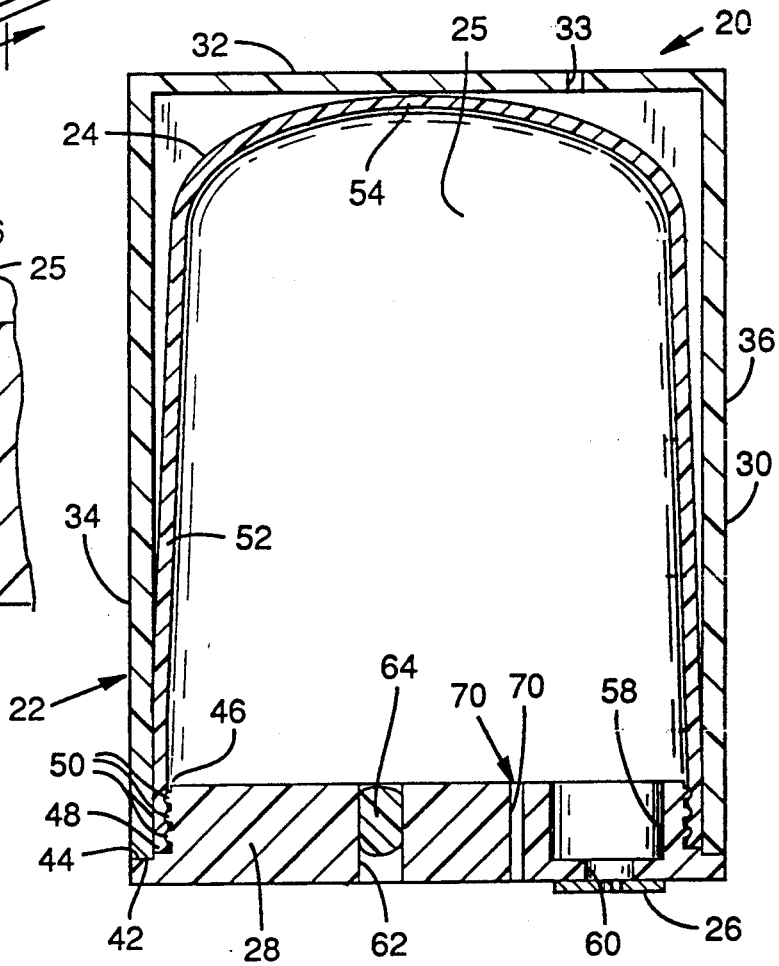
FIG. 2 is a side cross sectional view taken along line 2—2 of FIG. 1.

More particularly, the pen body 22 includes a five-sided housing 30 that is generally rectangular in top section (FIG. 3) and end section (FIG. 4), and approximately square in side section (FIG. 2). The housing 30 is formed of lightweight, rigid material, such as plastic, and includes a top wall 32, opposing end walls 34, 36, and opposing sidewalls 38, 40.

Figure 2A:
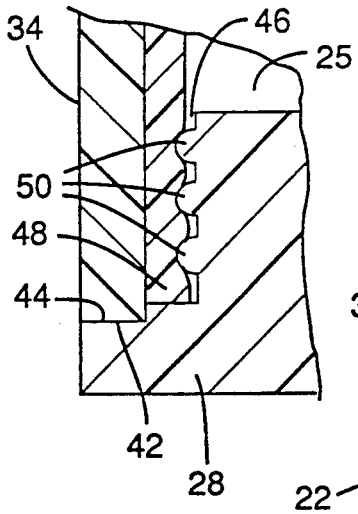
FIG. 2*a* is an enlarged sectional view showing a preferred technique of attaching the flexible bladder to the base of the pen.

The bottom edge 42 of the housing 30 is attached, as by heat-welding, to the flat base 28 of the pen 20. In this regard, the base 28 includes along its periphery a recess 44 into which the bottom edge 42 of the housing 30 snugly fits for welding thereto (FIG. 2*a*).

Above the recess 44, the base 28 is further recessed to define a gap 46 into which fits the open end 48 of the reservoir bladder 24. Preferably, the base 28 is constructed to have one or more (three shown in FIG. 2*a*) sealing ribs 50, which protrude from the base 28 into the gap 46 to pinch the open end 48 of the reservoir bladder 24 against the bottom inside surface of the housing 30. Consequently, the ribs 50 provide a fluidtight seal between the end 48 of the bladder 24 and the pen base 28.

It is contemplated that any of a variety of techniques may be used for attaching the bladder end 48 to the pen base 28 to achieve the fluid-tight seal just described.

The reservoir bladder 24 and base 28 define a reservoir volume 25 that stores ink that is gradually ejected from the pen by a print head 26, such as a conventional thermal-bubble type, that is mounted to the base 28 of the pen body 22.

The reservoir bladder 24 is generally elliptical in cross section (FIG. 3) having a continuous sidewall 52 and an integrally-formed hemi-ellipsoidal cap 54. Preferably, the bladder 24 is formed of material that has substantial resistance to air permeability and is chemically non-reactive with the components of the ink that is stored in the reservoir volume 25. To this end, it is preferred that the bladder 24 be formed of a butyl, nitrile, or neoprene rubber.

In a preferred embodiment, the bladder wall 52 is between 1000 and 1500 microns ($\mu$) thick and the bladder is sized to contain about 40.0 cubic centimeters (cc) of ink. The reservoir bladder 24 collapses as ink is ejected by the print head 26. The reservoir bladder 24 is sized so that the manner in which the reservoir bladder 24 collapses is most effective for allowing removal of substantially all of the ink in the reservoir. In this regard, the reservoir bladder 24 is sized so that the cap 54 of the bladder 24 is near, but not deformed by, the top wall 32 of the pen housing 30, and the long sides 56 of the bladder sidewall 52 (FIGS. 3 and 4) are slightly deformed inwardly by the sidewall 38, 40 of the housing 30 whenever the bladder 24 is in the fully expanded position (solid lines in FIGS. 3 and 4). The deformation of the sides 56 provides a slight inward reaction force that causes the long sides 56 at the bladder to collapse inwardly (dashed lines in FIGS. 3 and 4) as the back pressure within the reservoir bladder 24 increases as ink is ejected by the print head 26.

The reservoir volume is initially filled with ink that is conveyed through an ink hole 62 formed through the base 28. That hole 62 is later sealed with a plug 64.

As best shown in FIG. 2, the base 28 of the pen 20 includes a well 58 that is in fluid communication with the reservoir volume 25. The bottom of the well 58 is in fluid communication with a chamber 60 that leads to the print head 26. Operation of the print head 26 generates capillarity in the print head to draw ink into the chamber 60 and keep the chamber filled for supplying ink to the print head.

As mentioned earlier, ink-jet pens require mechanisms for preventing ink from permeating through the print head when the print head is inactive. Accordingly, a back pressure is established within the reservoir volume 25 at the time the reservoir bladder 24 is filled with ink. To this end, a small amount of ink is removed from the filled pen and sealed by, for example, syphoning a small amount of ink through the print head. Removal of the ink develops within the reservoir a back pressure that is sufficient to keep ink from leaking from the reservoir as the print head 26 remains inactive.

FIG. 6 is a graph showing the relationship between the changes in the reservoir back pressure (ordinate) as in the ink volume (abscissa) within the reservoir 25 is depleted during pen operation. The origin of the graph represents a filled reservoir that has yet to have removed from it an amount of ink sufficient for generating a back pressure within the reservoir volume 25. Point A on the graph represents the back pressure after a small amount (for example, 2 cc) of ink has been removed from the reservoir. As noted, this minimum back pressure (for example, 2.5 cm water column) developed as a result of this ink volume depletion is sufficient for keeping the ink from permeating through the print head 26 when the pen 30 is inactive.

As the print head 26 operates to eject ink from the reservoir volume 25, the consequent reduction in ink volume in the reservoir increases the back pressure. The reservoir bladder 24 begins to collapse under the influence of the back pressure increase. The housing 30 includes one or more holes 33 to allow ambient air to move between the bladder and housing so that no partial vacuum develops therebetween to impede collapse of the bladder.

The collapse of the bladder 24 reduces the reservoir volume 25 thereby regulating (that is, limiting) the back pressure so that the back pressure does not exceed a level that would cause the print head 26 to fail to eject ink. In a preferred embodiment, the bladder 24 is constructed to collapse by an amount that reduces the reservoir volume to approximately 50 percent of the original reservoir volume. The bladder, however, includes sufficient internal resilience to later expand, if necessary, to increase the reservoir volume as described more fully below.

During the time the bladder 24 collapses as ink is being ejected from the reservoir volume 25, the reservoir back pressure increases at a very gradual rate. The region of bladder collapse is depicted as the volume between points A and B in FIG. 6. Once the bladder 24 moves to its minimum or fully collapsed position (dashed lines in FIGS. 3 and 4), the back pressure increases somewhat sharply to a maximum level (C in FIG. 6) of about 11.0 cm water column. In the preferred embodiment, the maximum back pressure level C is substantially lower than the back pressure level (for example 30.0 cm water column) that may cause failure of a conventional print head 26. In accordance with the present invention, the ink delivery system is provided with a bubble generator 70 (FIG. 2) that directs air bubbles into the reservoir bladder 24 so that the back pressure within the reservoir volume is limited to that maximum level C just mentioned. More particularly, the bubble generator 70 in a preferred embodiment comprises a small-diameter orifice 72 (for clarity, shown greatly enlarged in the figures) that extends completely through the base 28 of the pen 20. The diameter of the bubble generator orifice 72 is small enough so that the surface tension of the ink within the reservoir 25 is great enough to prevent the ink from leaking through the orifice out of the pen 20. Moreover, the diameter of the orifice 72 is small enough (for example, 200 $\mu$) so that ambient air will not move through the bubble generator 70 into the ink-covered bottom of the reservoir 25 in the absence of sufficient back pressure developed within the reservoir volume 25. In this regard, air bubbles are introduced directly into the reservoir volume 25 through the bubble generator 70 whenever the reservoir back pressure reaches the maximum level C discussed above.

The introduction of air bubbles into the reservoir 25 increases the fluid volume therein, hence reducing the back pressure to a level (point D in FIG. 6) of about 10.0 cm water column. At this level D, the bubble generator 70 halts the introduction of air bubbles as the capillarity of the orifice 72 overcomes the (reduced) reservoir back pressure to draw a small amount of reservoir ink therein to "seal" the orifice. As the print head 26 thereafter continues to eject ink from the reservoir 25, thereby decreasing the reservoir volume, the back pressure again reaches the level corresponding to C in FIG. 6 that is sufficient to draw air through the bubble generator 70 to again reduce the back pressure to a level corresponding to D in FIG. 6. This increase and decrease cycle of the back pressure continues until substantially all of the ink is removed from the reservoir 25, at which point (E in FIG. 6) ambient air is drawn into the reservoir volume 25 and the back pressure drops to ambient (point F in FIG. 6).

In some applications it may desirable to close the bubble generator orifice whenever the pen is inverted while some reservoir ink remains in the pen. Such inversion of the pen without closing the bubble generator orifice would likely remove the ink/air interface in the bubble generator, thereby permitting ambient air to enter the reservoir and eliminate all of the back pressure within the pen.

FIG. 5 depicts another preferred embodiment of a bubble generator 70' that includes a mechanism for closing the bubble generator orifice 72' whenever the pen is inverted. More particularly, the bubble generator 70' includes an orifice 72' that has a reduced diameter portion 82 located near the base surface 29 that faces the reservoir volume 25. The bubble generator 70' also includes a number of spaced apart ribs 86 that protrude into the orifice 72' near the bottom surface 31 of the base 28. The reduced-diameter portion 82 and ribs 86 contain within the mid-portion of the orifice 72' a check ball 80. When the pen is in the upright position (FIG. 5) the ball 80 rests on the ribs 86 and permits air to pass completely through the bubble generator 70' whenever the back pressure reaches the maximum level discussed earlier. Whenever the pen is inverted, the ball 80 moves to close the opening in the reduced-diameter portion 82 thereby preventing air from entering the reservoir 25.

As mentioned earlier, ink-jet pens may be exposed to environmental conditions that cause fluctuation in the reservoir back pressure. For example, an ambient air pressure decrease could cause leakage of the print head unless the back pressure is increased to counter the ambient pressure drop. The internal resilience of the reservoir bladder 24 of the present invention is sufficient the expand the bladder (hence increasing the reservoir volume and back pressure) in response to such environmental effects. For example, referring to FIG. 6, a preferred bladder configuration in the fully collapsed position (point B FIG. 6) is expandable to increase the reservoir volume by about 20 cc. Such a large volumetric expansion will be sufficient to accommodate the most serve environmental effects normally encounter by a pen. It can be appreciated that this large reservoir volume increase produced by the reservoir bladder will sufficiently regulate the back pressure without the need to incorporate a catch basin in the pen. In short, the flexible reservoir bladder 24 when used in conjunction with the bubble generator 70, provides a highly efficient ink delivery system for the pen.

While having described and illustrated the principles of the invention with reference to preferred embodiments and alternatives, it should be apparent that the invention can be further modified in arrangement and detail without departing from such principles. For example, the configuration of the housing can be made to substantially conform to the bladder configuration while still providing the preferred collapse mode described earlier. Moreover, a multitude of bladder configurations (for example, a capped cylindrical configuration) may be employed, or the bladder can be specially designed to correspond to the configuration of an existing housing of a pen that employs a different ink delivery system, so that the present system can be substituted therefor.

In view of the above it is to be understood that the present invention includes all such modifications that may come in the scope and spirit of the following claims and equivalents thereof.

We claim:

1. An ink delivery system, comprising:

a pen body having a base and a housing attached to the base;

a deformable bladder disposed inside the housing in contact with the housing so that opposing sides of the bladder are slightly deformed by the housing and having an open end sealed to the base of the pen body, the bladder and base defining a reservoir volume for containing ink;

print head means connected to the base for ejecting ink from the reservoir volume, a back pressure within the reservoir volume increasing an ink is ejected therefrom; and bubble generator means for delivering air through the base and through the open end of the bladder and into the reservoir volume whenever the back pressure within the reservoir volume.

2. The system of claim 1 wherein the bubble generator means includes an orifice formed through the base of the pen body.

3. The system of claim 1 wherein the bladder includes a sidewall and integrally formed cap, the bladder being shaped to substantially fill the housing so that the bladder and base define the entire reservoir volume.

4. The system of claim 3 wherein the bladder is sized so that a portion of the bladder sidewall is deformed by the housing whenever the reservoir is filled with ink.

5. The system of claim 1 wherein the bladder includes a sidewall and integrally formed cap, the bladder being movable between an expanded position that defines a maximum reservoir volume and a collapsed position that defines a minimum reservoir volume, the cap located so that the cap is not deformed whenever the bladder is in the expanded position.

6. An ink-containing pen comprising:

a base;

a flexible reservoir bladder having an open end attached to a surface of the base, the bladder having a sidewall and an integrally formed cap, the sidewall, cap and surface of the base defining a reservoir volume for storing substantially all of the ink contained by the pen; and an orifice formed in the base to provide fluid communication between ambient air and the reservoir volume.

7. The pen of claim 6 further comprising a rigid housing having walls enclosing the bladder and shaped so that the bladder sidewall and cap are adjacent to housing walls.

8. The pen of claim 7 wherein the bladder assumes a fully expanded position whenever the reservoir volume is filled with ink, the housing being shaped so that a portion of the bladder sidewall is deformed whenever the bladder is in the expanded position.

9. The pen of claim 6 wherein the bladder has an elliptical cross section.

10. The pen of claim 6 wherein the orifice includes closing means for closing the fluid communication whenever the pen is inverted.

11. The pen of claim 6 wherein the bladder and orifice are configured so that the bladder collapses to reduce the reservoir volume by more than 40% before the orifice provides fluid communication between ambient air and the reservoir volume.

* * * * *

UNITED STATES PATENT AND TRADEMARK OFFICE

CERTIFICATE OF CORRECTION

PATENT NO : 5,153,612

DATED : October 6, 1992

INVENTOR(S) : John G. Dunn, et al.

It is certified that error appears in the above-identified patent and that said Letters Patent is hereby corrected as shown below:

Column 8, Line 14 of the Patent, add

-- is caused to increase to a predetermined level -- after volume and before the ending period.

Signed and Sealed this

Eighth Day of December, 1998

*Attest:*

*Attesting Officer*

BRUCE LEHMAN

*Commissioner of Patents and Trademarks*